US007797154B2

(12) United States Patent
Ichikawa

(10) Patent No.: US 7,797,154 B2
(45) Date of Patent: Sep. 14, 2010

(54) SIGNAL NOISE REDUCTION

(75) Inventor: Osamu Ichikawa, Ebina (JP)

(73) Assignee: International Business Machines Corporation, Armonk, NY (US)

( * ) Notice: Subject to any disclaimer, the term of this patent is extended or adjusted under 35 U.S.C. 154(b) by 190 days.

(21) Appl. No.: 12/127,573

(22) Filed: May 27, 2008

(65) Prior Publication Data

US 2008/0306734 A1 Dec. 11, 2008

(51) Int. Cl.
*G10L 21/02* (2006.01)

(52) U.S. Cl. ..... 704/226; 704/233; 704/234; 704/219; 704/253; 381/94.3; 381/94.2; 381/94.7; 381/92

(58) Field of Classification Search ..... 704/226, 704/233, 234, 219, 232, 253; 381/94.3, 94.2, 381/94.7, 92

See application file for complete search history.

(56) References Cited

U.S. PATENT DOCUMENTS 5,644,641 A 7/1997 Ikeda
5,668,927 A * 9/1997 Chan et al. ..... 704/240
5,706,395 A 1/1998 Arslan et al.
5,806,025 A * 9/1998 Vis et al. ..... 704/226
5,848,163 A * 12/1998 Gopalakrishnan et al. ..... 381/56
5,878,389 A * 3/1999 Hermansky et al. ..... 704/226
5,970,452 A * 10/1999 Aktas et al. ..... 704/253
5,974,373 A 10/1999 Chan et al.
6,032,115 A * 2/2000 Kanazawa et al. ..... 704/234
6,104,321 A * 8/2000 Akagiri ..... 341/50
6,108,610 A * 8/2000 Winn ..... 702/77
6,144,937 A * 11/2000 Ali ..... 704/233
6,167,373 A 12/2000 Morii
6,205,421 B1 * 3/2001 Morii ..... 704/226
6,230,122 B1 * 5/2001 Wu et al. ..... 704/226
6,263,307 B1 7/2001 Arslan et al.
7,065,486 B1 6/2006 Thyssen
7,106,541 B2 9/2006 Bruner et al.
2004/0122662 A1 * 6/2004 Crockett ..... 704/200.1
2005/0251388 A1 * 11/2005 Lang et al. ..... 704/226

OTHER PUBLICATIONS

Office Action from U.S. Appl. No. 11/075,519 dated Aug. 20, 2008.

Boll, "Suppression of Acoustic Noise in Speech Using Spectral Subtraction," IEEE Trans. On ASSP, vol. ASSP-27, pp. 113-120, Apr. 1979.

(Continued)

*Primary Examiner*—Vijay B Chawan
(74) *Attorney, Agent, or Firm*—Louis Herzberg; Shimokaji & Assoc.

(57) ABSTRACT

Provision to reduce production of musical noise. A noise reduction device includes: means for calculating a rank for each element included in a first region having predetermined sizes in the time axis direction and in the frequency axis direction, depending on a value of the element, in a noise section of an observed signal indicating variation of a frequency spectrum with time; means for calculating a rank for each element included in a second region, depending on a value of the element, the second region having predetermined sizes in the time axis direction and in the frequency axis direction in the observed signal; and means for subtracting, from the values of the respective elements in the second region, values based on the values of the respective elements in the first region whose ranks correspond to ranks of respective elements in the second region.

8 Claims, 18 Drawing Sheets

OTHER PUBLICATIONS

Lockwood, "Experiments With a Nonlinear Spectral Subtractor (NSS), Hidden Markov Models and Projection, for Robust Recognition in Car," Speech Communications, vol. 11, pp. 215-228, Jun. 1992.

Nolazco et al., "Continuous Speech Recognition in Noise Using Spectral Subtraction and HMM Adaptation," Proc. Of ICASSP, 1994, vol. I, pp. 409-412.

Whipple, "Low Residual Noise Speech Enhancement Utilizing Time-Frequency Filtering," ICASSP94.

Yariv Ephraim et al., "Speech Enhancement Using a Minimum Mean-Square Error Short-Time Spectral Amplitude Estimator", IEE Transactions on Acoustics, Speech, and Signal Processing, vol. ASSP-32, No. 6, Dec. 1984, pp. 1109-1121.

* cited by examiner

FIG.,6

SIGNAL NOISE REDUCTION

FIELD OF THE INVENTION

The present invention relates to a noise reduction device, a noise reduction method and a noise reduction program for eliminating a noise component in an observed signal with spectral subtraction, which suppress production of a "musical" noise.

BACKGROUND OF THE INVENTION

The spectral subtraction method (herein after referred to as the "SS method"), the Wiener filtering method, the minimum mean-squared error (MMSE) method and the like have been heretofore known as techniques for suppressing noise components in an observed signal based on a speech on which noises are superimposed.

The existence of stationary noise is a prerequisite for the SS method. The SS method is designed to learn an average power of noise components for each frequency in a noise section, which is a non-speech section, and to subtract the average power of the noise signal from the power of the observed signal in a speech section for each frequency (see Non-patent Document 1, for example). When the subtraction is done, the average power of the noise components is normally multiplied by an excessive subtraction weight in a range of 1.0 to 4.0. When an output as a result of the subtraction drops below 0.01 to 0.5 times the power of the original speech signal, processing or "flooring" is performed together where the result of the subtraction is replaced with a value which is obtained by multiplying the original speech signal by a "flooring" coefficient.

If a larger subtraction weight is introduced, a "musical" noise is reduced. However, loss of information and speech distortion in a speech section become conspicuous. For this reason, a larger flooring coefficient is needed for compensating for the loss of information and the speech distortion. Nevertheless, if a lager flooring coefficient is introduced, the power of a noise signal is not reduced sufficiently. If, therefore, there would be a measures to inhibit a musical noise from being produced even in a case that a small subtraction weight in a range of 1.0 to 1.5 is used, the loss of a speech and a speech distortion to be brought about after the subtraction can be suppressed to a minimum, and concurrently a smaller flooring coefficient in a range of 0.01 to 0.1 can be introduced. Accordingly, the power of the noise signal can be reduced sufficiently.

The following literature is considered:

[Non-patent Literature 1] S. Boll, "Suppression of Acoustic Noise in Speech Using Spectral Subtraction," IEEE Trans. on ASSP, Vol. ASSP-27, pp. 113-120, April 1979

[Non-patent Literature 2] Lockwood, P., Boudy, J., "Experiments with a Nonlinear Spectral Subtractor (NSS), Hidden Markov Models and Projection, For Robust Recognition in Car," Speech Commun, Vol. 11, pp. 215-228, June 1992

[Non-patent Literature 3] J. A. Nolazco Flores, S. J. Young, "Continuous Speech Recognition in Noise Using Spectral Subtraction and HMM Adaptation," Proc. of ICASSP, 1994, Vol. I, pp. 409-412

[Non-patent Literature 4] Gary Whipple, "Low Residual Noise Speech Enhancement Utilizing Time-Frequency Filtering," ICASSP-94

[Non-patent Literature 5] Y. Ephraim, D. Malah, "Speech Enhancement Using a Minimum Mean-Squared Error Short-Time Spectral Amplitude Estimator," IEEE Trans. on ASSP, Vol. ASSP-32, pp. 1109-1121

The SS method has a plurality of derivative methods. Among them are a non-linear spectral subtraction (NSS) method, which is designed to adjust only a subtraction weight for each frequency in response to a signal-to-noise ratio (SNR)(see Non-patent Literature 2, for example), and a continuous spectral subtraction (CSS) method, which is designed to subtract a local average power in a real-time manner without discriminating between a noise section and a speech section (see Non-patent Literature 3, for example). In these methods, however, a musical noise is produced, even though their levels of the musical noise is lower.

A post-mortem method has been proposed where an output to be obtained after processing by the SS method is observed and a musical noise and its equivalent are reduced if they are found. Specifically, a power of a spectrum is observed in the system of coordinates constituted of a time axis and a frequency axis, thereby erasing a portion which looks like an isolated island (see Non-patent Literature 4, for example), or thereby reducing it with a median filtering. In addition, there is a spectral smoothing method for smoothing powers over several neighboring frames. However, these methods have their own limits, and performance in reducing a musical noise is insufficient.

To begin with, a musical noise results from "subtraction" processing. It is assumed that a musical noise is not produced if a speech signal to be obtained after reducing a noise component is produced by "multiplication" instead of "subtraction."

The Wiener filtering method is designed to estimate a clean speech with some measures, and to define a transfer function of the Wiener filtering in a way that the transfer function agrees with the estimated clean speech. In this point, since the clean speech is unknown by nature, an estimated value concerning the speech is used. Depending upon measures to estimate the estimated value, therefore, the property of the Wiener function to be implemented varies to a large extent. Generally speaking, even though this method is employed, it is difficult to make reduction in a residual noise and minimization of speech distortion compatible with each other.

The MMSE method is designed to adjust a multiplication coefficient for each frequency by use of a minimum square method on a presumption that independent power distributions are present in a noise and a speech respectively (see Patent Literature 5, for example). Since multiplication is done, a musical noise is not produced. However, a speech processed by the MMSE method has a large amount of speech distortion. This speech distortion is conspicuous, particularly in a case that the speech distortion is measured by a widely-used MEL-cepstral representation. For this reason, the MMSE method is not suitable for its adaptation to speech recognition.

It is desirable to achieve clear speech in a severe noise environment such as an emergency telephone call made in a highway. In addition, a speech enhancement technique for offering higher articulation has been awaited in the field of hearing aids for people with hearing impairment.

An SS method which is designed to subtract an average spectrum of noise components from an observed signal is effective for reducing noise components from an observed signal based on a speech on which a stationary noise is superimposed. However, a conventional SS method can not avoid producing an offensive musical noise as a side effect.

In other words, in the present framework of the SS method, clarity of a speech and performance in speech recognition can not be compatible with each other. For the purpose of suppressing speech distortion to a minimum level, it is desirable to introduce a smaller subtraction weight. When the subtraction weight is set smaller, however, noise components which can not be subtracted are large in number, thus deteriorating performance in speech recognition in a noise environment. For the purpose of lowering the overall noise power including noise power in non-speech sections, it is desirable to introduce a smaller flooring coefficient. When the flooring coefficient is set smaller, however, a musical noise is conspicuous, thus causing errors to crop up with regard to a short word. Consequently, if performance in speech recognition is intended to be enhanced with priority given, clarity of a speech in terms of auditory sense may be sacrificed in some cases.

For the same reason, in a conventional SS method, performance in speech recognition based on an observed signal to be obtained after noises are reduced is susceptible to an influence caused by the two parameters of a subtraction weight and a flooring coefficient. Optimal parameter values vary depending upon the quantities (S/N) and qualities of noises and further on a task of speech recognition. For this reason, the optimal parameter values are somewhat difficult to obtain in an actual environment. To achieve more robust speech recognition, a method for reducing noises which is not sensitive to variation of the parameters has been awaited.

SUMMARY OF THE INVENTION

Thus, considering the problems in the prior art, an aspect of the present invention is to reduce production of musical noise efficiently without any trouble when noise is reduced by use of the SS method. In order to achieve the aspect, a noise reduction device according to the present invention comprises: first rank calculating means for calculating a rank for each of elements included in a first region, depending upon a value of the element, the first region having predetermined sizes in a time axis direction and in a frequency axis direction, in a noise section in an observed signal indicating variation of a frequency spectrum with time; second rank calculating means for calculating a rank for each element included in a second region, depending upon a value of the element, the second region having predetermined sizes in the time axis direction and in the frequency axis direction in the observed signal; and subtraction means for subtracting, from the values of the respective elements in the second region, values based on values of the respective elements in the first region whose ranks correspond to the ranks of the respective elements of the second region.

Another aspect of the present invention is provision of a noise reduction method including: a first rank calculating step for calculating a rank for each of elements included in a first region, depending upon a value of each element. The first region having predetermined sizes in the time axis direction and in the frequency axis direction in a noise section in an observed signal indicating variation of a frequency spectrum with time. The method also includes a second rank calculating step for calculating a rank for each element included in a second region, depending upon a value of the element. The second region having predetermined sizes in the time axis direction and in the frequency axis direction in the observed signal. The method also includes a subtraction step for subtracting, from the values of the respective elements in the second region, values based on values of the respective elements in the first region whose ranks correspond to those of the elements of the second region.

Here, observed data are, for example, what are obtained by converting a speech signal, which noise components are superimposed on, into a time series of a short time spectrum by a predetermined frame length and by a predetermined frame period. Values of the respective elements are, for example, an amplitude and intensity of the element. When a subtraction is done, a value to be subtracted may be multiplied by a subtraction coefficient, as in the case of the conventional SS method. Also, when a subtraction is done, if a value to be found as a result of the subtraction is smaller than a value to be found by multiplying the observed data by a flooring coefficient, the value as the result of the subtraction may be replaced with the value to be obtained by multiplying the observed data by the flooring coefficient. Incidentally, a noise section in the observed data means a time frame where only noise components are included in the observed signal.

In another preferable aspect of the present invention, a plurality of first and second regions are set in the frequency axis direction for each of predetermined increases in a frequency. Positions where the first regions are set are renewed sequentially in order to cause the positions to be located at predetermined timing in the time axis direction. Positions where the second regions are set are renewed sequentially in order to sequentially change the positions at predetermined time position intervals.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE INVENTION

Figure 1:
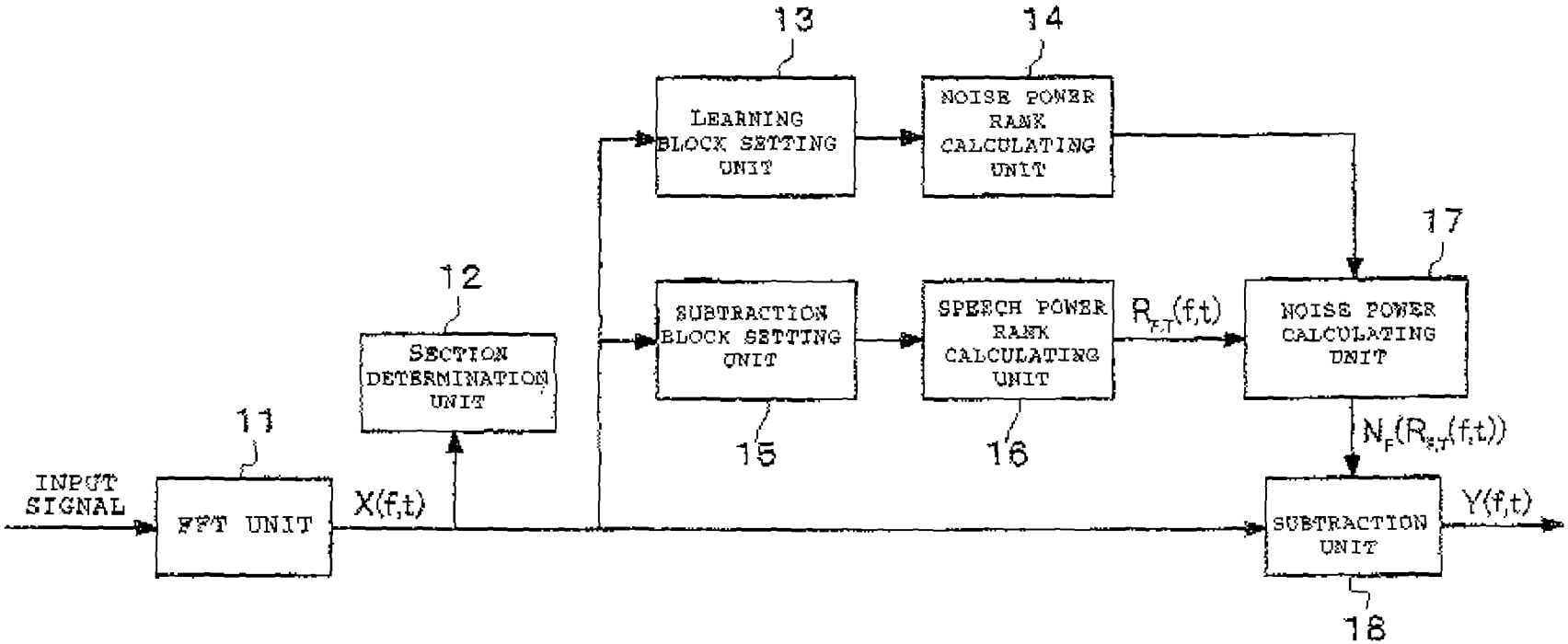
FIG. 1 is a system block diagram showing an example of a noise reduction device according to an embodiment of the present invention.

The present invention provides method systems and apparatus to reduce production of musical noise efficiently without trouble when noise is reduced by use of the SS method. An example of a noise reduction device according to the present invention comprises: first rank calculating means for calculating a rank for each of elements included in a first region, depending upon a value of the element, the first region having predetermined sizes in a time axis direction and in a frequency axis direction, in a noise section in an observed signal indicating variation of a frequency spectrum with time; second rank calculating means for calculating a rank for each element included in a second region, depending upon a value of the element, the second region having predetermined sizes in the time axis direction and in the frequency axis direction in the observed signal; and subtraction means for subtracting, from the values of the respective elements in the second region, values based on values of the respective elements in the first region whose ranks correspond to the ranks of the respective elements of the second region.

In addition, a noise reduction method according to the present invention includes a first rank calculating step for calculating a rank for each of elements included in a first region, depending upon a value of each element, the first region having predetermined sizes in the time axis direction and in the frequency axis direction in a noise section in an observed signal indicating variation of a frequency spectrum with time; a second rank calculating step for calculating a rank for each element included in a second region, depending upon a value of the element, the second region having predetermined sizes in the time axis direction and in the frequency axis direction in the observed signal; and a subtraction step for subtracting, from the values of the respective elements in the second region, values based on values of the respective elements in the first region whose ranks correspond to those of the elements of the second region.

Here, observed data are, for example, that which are obtained by converting a speech signal onto which noise components are superimposed, into a time series of a short time spectrum by a predetermined frame length and by a predetermined frame period. Values of the respective elements are, for example, an amplitude and intensity of the element. When a subtraction is done, a value to be subtracted may be multiplied by a subtraction coefficient, as in the case of the conventional SS method. Also, when a subtraction is done, if a value to be found as a result of the subtraction is smaller than a value to be found by multiplying the observed data by a flooring coefficient, the value as the result of the subtraction may be replaced with the value to be obtained by multiplying the observed data by the flooring coefficient. Incidentally, a noise section in the observed data means a time frame where only noise components are included in the observed signal.

In this constitution, a value of each of the elements in a noise section in an observed signal is subtracted from a value of each of the elements in the observed signal, thereby reducing a noise component from the observed signal. However, when such a spectral subtraction is done, an average of values of the respective elements in a noise section in an observed signal has been heretofore subtracted from values of the respective elements in the observed signal. For this reason, a value corresponding to unevenness of a distribution of noise values has been over-subtracted or under-subtracted, thereby causing a problem of producing a musical noise.

By contrast, according to the present invention, for each of elements included in the first region in a noise section in an observed signal and for each of the elements included in the second region in the observed signal, ranks depending upon values of the elements are calculated respectively. Then, values based on values of the respective elements in the first region whose ranks correspond to ranks of elements in the second region are subtracted from values of the respective elements in the second region. Accordingly, a larger noise value of an element with a higher rank in the first region is subtracted from an element with a higher rank in the second region which is considered to include more noise components, and a smaller noise value of an element with a lower rank in the first region is subtracted from an element with a lower rank in the second region which is considered to include fewer noise components. Consequently, problems of over-subtraction and under-subtraction of the noise value can be solved, and a musical noise can be suppressed.

In a preferable aspect of the present invention, a plurality of first and second regions are set in the frequency axis direction for each of predetermined increases in a frequency. Positions where the first regions are set are renewed sequentially in order to cause the positions to be located at predetermined timing in the time axis direction. Positions where the second regions are set are renewed sequentially in order to sequentially change the positions at predetermined time position intervals.

Plurality of first and second regions may be set in the respective frequency axis directions for each of predetermined increases in a frequency, and during that, the sizes of the first and second regions may be caused to be changed respectively depending upon a distribution of noise components in the frequency axis direction. Furthermore, in a case that components of a periodic noise is included in an observed signal, the sizes of the first and second regions in the respective time axis directions may be set equal to, or larger than, a cycle of the periodic noise. In addition, in the present invention, an element in the first region whose rank corresponds to that of an element in the second region is, for example, an element in the first region whose relative rank corresponds to that of an element in the second region.

Additionally, ranks of the respective elements of the first and second regions are segmented into a plurality of ranges of ranks in each of the first and second regions, and segments in the first region and segments of the second region are caused to correspond to each other sequentially starting from a lower rank, thereby enabling the segments in the first region and the corresponding segments in the second region to be made different in terms of the range of relative ranks. In this case, as an element in the first region whose rank corresponds to that of an element in the second region, the following element can be adopted; the element is an element belonging to a segment in the first region corresponding to a segment to which an element in the second region belongs, and concurrently an element whose rank in a segment in the first region relatively corresponding with the rank of an element of the second region in a segment of the second region.

In this case, for example, it is allowed that ranks of the respective elements in the first region are divided into two ranges of ranks by defining a median of all the ranks as a boundary, and concurrently ranks of the respective elements in the second region are divided into two ranges of ranks by defining as a boundary a rank of an element in the second region, whose value is equal to the value of the aforementioned median.

As an observed signal, for example, what is obtained by converting a speech signal, which noise components are superimposed on, into a time series of a short time spectrum by a predetermined frame length and by a predetermined frame period can be used. In that case, however, it is allowed that each element is present for each frequency sub-band in each frame, the first region is set in order that the first region has a size which is obtained by multiplying a predetermined number of frames by the predetermined number of frequency sub-bands, and the second region is set in order that the second region has a size which is obtained by multiplying a predetermined number of frames by the same number of frequency sub-bands as the first region has.

Qqqqqqqqqqqqqq

According to the present invention, production of a musical noise can be suppressed effectively. In addition, values of a subtraction coefficient and a flooring coefficient are maintained at preferable values, thereby enabling production of the musical noise to be reduced effectively while suppressing speech distortion.

Figure 4:
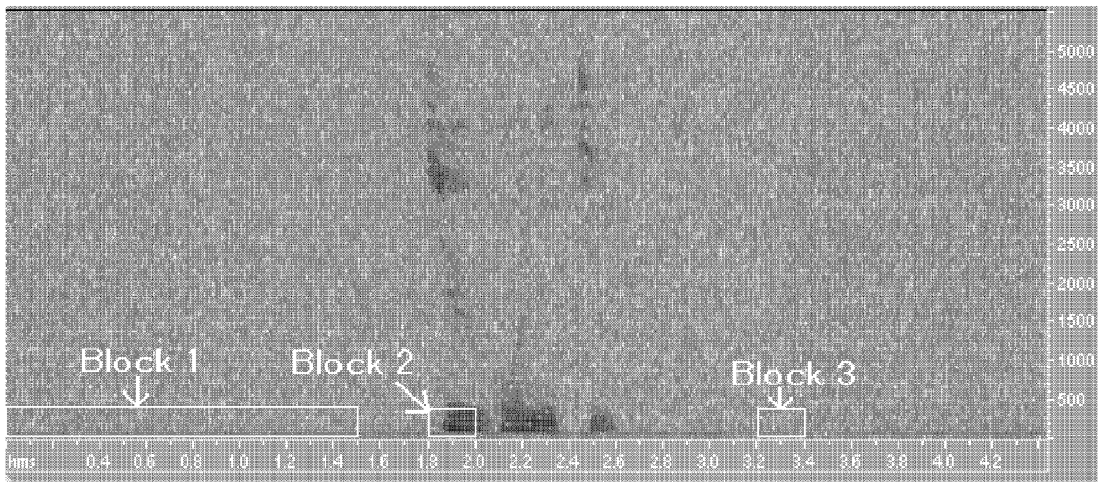
FIG. 4 is an example of a spectrogram of a test speech which is obtained by superimposing a white noise on a speech "Ju-Go-Nichi" voiced by a man.

First of all, a description will be provided for a mechanism in which a musical noise is produced. FIG. 4 is a spectrogram of a test speech which is obtained by superimposing a white noise onto a speech "Ju-go-nichi" voiced by a man. A Block1 in the figure is an inspection region (herein after referred to as a "Block1") having a size of 150×10 (the number of frames*the number of frequency sub-bands), and Block1 is constituted of elements of each of the frequency sub-bands in each frame. Block1 has a center frequency of 215 Hz, and Block1 is set in a noise section in order to examine a power distribution of noise in the center frequency. A block 2 is an inspection region (herein after referred to as a "Block2") having a size of 20×10 (the number of frames*the number of frequency sub-bands), and is constituted of elements of each of the frequency sub-bands in each frame. The center frequency of Block2 is 215 Hz, and the center frame is located at a time of 1.9 seconds. Block2 is set in order to examine a power distribution of a speech in this center frequency and in this center frame. A Block3 is an inspection region (herein after referred to as a "Block3") in a noise section, which is different from Block2 only in center frame.

Figure 5:
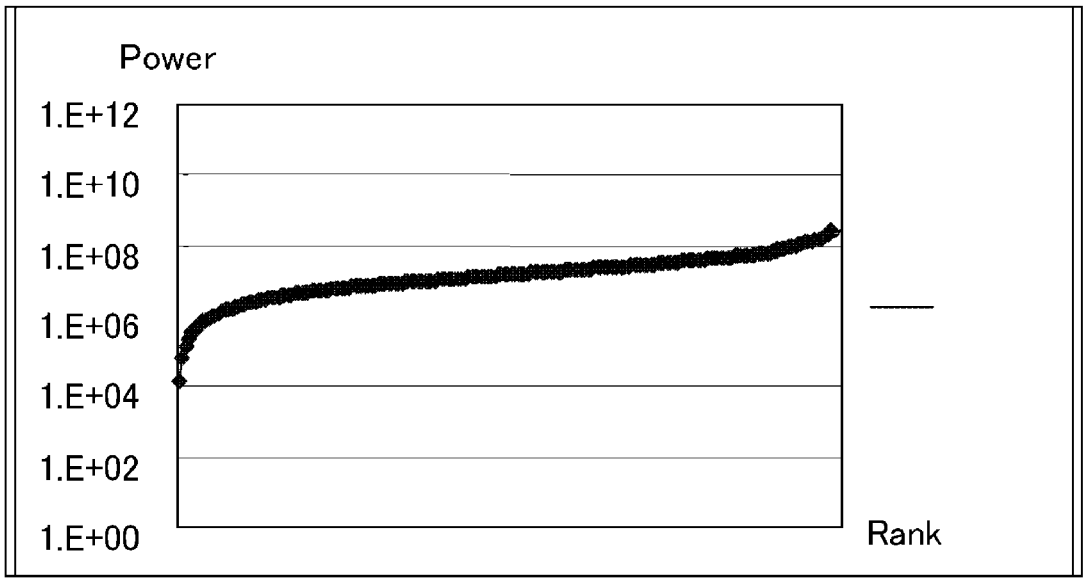
FIG. 5 is an example of a graph showing an example of a result of ranking a noise power by use of the power value for each of all the elements included in a learning block in a noise section.

FIG. 5 is a graph showing, with the axis of abscissa assigned to ranks and the axis of ordinates assigned to powers, a result of ranking speech powers concerning all the 1,500 elements included in Block1 from a speech power with a smallest value to a speech power with a largest value. As is understood from the figure, white noise even if called stationary, is not necessarily stationary when viewed locally. There are a difference denominated by the fourth power of 10 between the minimum value and the maximum value of the power. Consequently, if attention is paid only to an average of noise powers and the average is subtracted from a speech power of each element as in the case of the conventional SS method, it is understood that under-subtraction and over-subtraction of a noise power are caused for many of the elements. Powers thus under-subtracted and over-subtracted are a cause of a musical noise.

Figure 6:
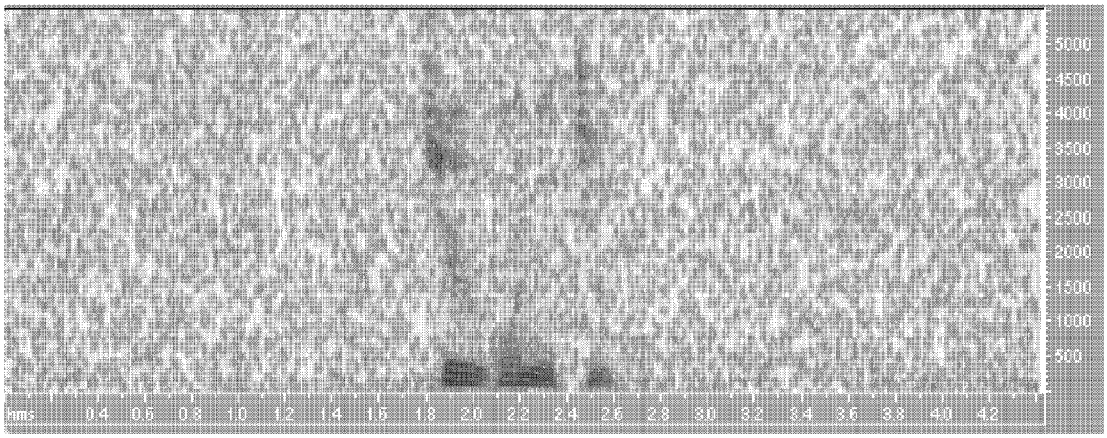
FIG. 6 is an example of a spectrogram of a speech to be obtained after a spectral subtraction is done by use of a conventional SS method.

FIG. 6 is a spectrogram of the speech shown in FIG. 4 to be obtained when a spectral subtraction is done by use of the conventional SS method. A subtraction weight used is 1.5, and a flooring coefficient used is 0.0. According to the conventional SS method, a musical noise as shown in FIG. 6 is produced.

Next, a description will be provided for a method of reducing a musical noise according to the present invention. This method can be understood image-wise as a trial where a noise spectrum in a frequency-time (frame) plane is considered as a texture (a ground pattern), and where pattern portions having the same texture are deleted for each sub-block in a plane as shown in Block2 and Block3 of FIG. 4. A texture is random microscopically. For this reason, blocks whose textures are completely the same do not exist even in a noise section. Consequently, a texture can not be deleted by a simple subtraction. However, in a case that the size of a block is set larger, it can be considered that the power distributions in the enlarged blocks are almost identical like the power distribution shown in FIG. 5 when viewed as a block unit in a noise section.

In other words, it can be considered that Block3 in FIG. 4 has a power distribution similar to the power distribution in FIG. 5 which has been learned in Block1 in FIG. 4. Consequently, a noise power to be subtracted in each of the elements of Block3 can be found through the following procedure; first, a rank based on a power value is found for each of the elements in Block3, and then a power value of an element whose relative rank agrees with the found rank is acquired in the power distribution in FIG. 5, which has been already learned. In this way, a power value found for each element in Block3 is subtracted from a power of the element, thereby enabling under-subtraction and over-subtraction of a noise power for the element to be suppressed to a minimum. A noise reduction method based on this theory is referred to as a "rank based spectral subtraction method" (herein after referred as an "RBSS method"). The RBSS method can be adapted to a section where a speech is present as in a case of Block2 in FIG. 4.

Figure 7:
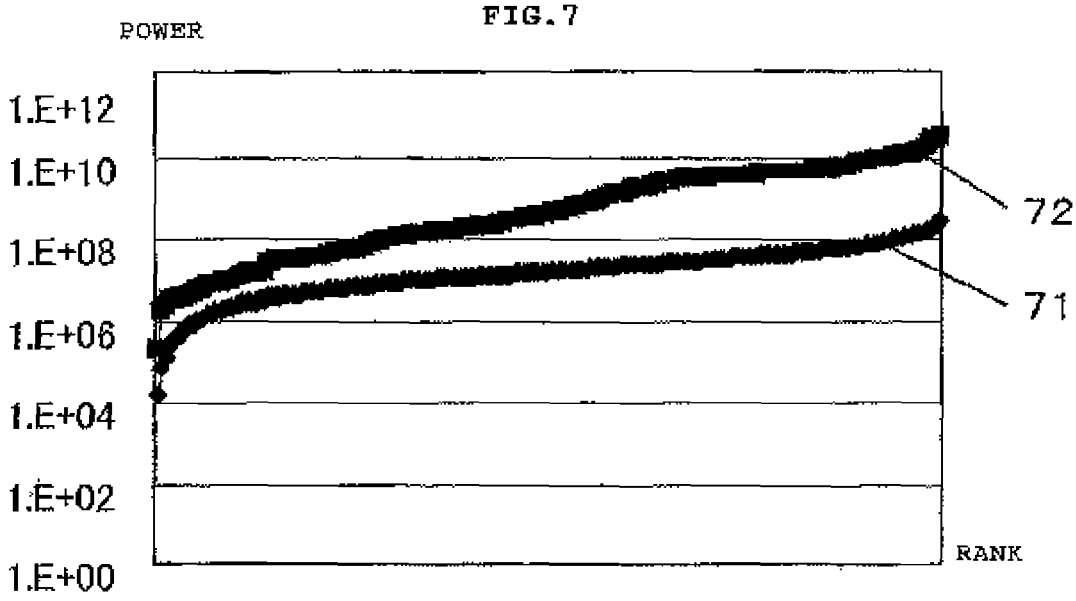
FIG. 7 is an example of a graph showing an example of a power distribution in each of a Block2 and a Block1 of FIG. 4.

FIG. 7 shows power distributions of Block1 and Block2 in FIG. 4 as in the case of FIG. 5. Reference numeral 71 in FIG. 7 denotes a sequence of points showing an example of a power distribution of Block1; and 72, a sequence of points showing a power distribution of Block2. An element in Block2 on which speech components are superimposed has an extremely high power, accordingly placing the element at a higher rank. According to the RBSS method, for an element in Block2, a noise power of an element in Block1 whose relative rank agrees with a rank of the element in Block2 is referred to. For this reason, an element having a higher noise power in Block1 is allotted concentratedly to an element in a portion mainly in Block2 on which a speech is superimposed.

Apparently, this seems to be a factor to deteriorate a speech signal. However, in a condition that there is a difference denominated by the second power of 10 between a speech power and a noise power as shown in FIG. 7, even if the noise power is subtracted from the speech power in the corresponding element, this subtraction does not have a large affect on the speech signal since the level of the speech power and the level of the noise power are different from each other. In a condition different from that, in other words, in a condition that there is no substantial difference in level between a speech power and a noise power, the RBSS method is not extremely disadvantageous compared to the conventional SS method since the framework of the SS method by itself is not designed to cause a speech power to crop up. Incidentally, when a noise power is subtracted, the RBSS method does the subtraction after multiplying the noise power by a subtraction weight, as in the case of the regular SS method.

In the aforementioned manner, a subtraction of a noise power, taking into consideration a mapping by use of a rank of a power distribution between a learning block as shown by Block1 of FIG. 4 and a subtraction block as shown by Block2 and Block3 corresponding to the learning block, is done at positions respectively in the time axis direction and in the frequency axis direction, thereby enabling an estimate value of a clean speech power to be found. As in the case of blocks 81 to 83 in FIG. 8, however, positions (ω, T), (ω+Δω, T) and (ω, T+ΔT) of blocks in their frequency axis direction and in their time axis direction as well as the sizes of Blocks can be set in a way that the regions of the respective blocks are overlapped with each other. For this reason, there can be a case where a plurality of estimated values are found for a certain element of a frame and a frequency sub-band. In such a case, an average of the plurality of estimated values is defined as a definitive estimated value of the element. After the definitive estimated value is found, the flooring is performed, and a value to be found as a result is outputted, as in a case of the regular SS method.

Processing by use of the aforementioned RBSS method is shown by the following equations.

[Equations 1]

$$R_{F,T}(f,t) = rank_{F,T}(X(f,t)) \tag{1}$$

$$S_{F,T}(f,t) = X(f,t) - a \cdot N_F(R_{F,T}(f,t)) \tag{2}$$

$$Y(f,t) = \max\left\{\frac{1}{M_{f,t}} \cdot \sum_{F,T} S_{F,T}(f,t),\ b \cdot X(f,t)\right\} \tag{3}$$

Here, f and t are an ordinal number of a frequency sub-band of each element and an ordinal number of a frame thereof respectively, and X(f, t) is an observed value of an element (f, t). F and T are indices in the frequency axis direction and in the time axis direction for the purpose of identifying a subtraction block, and $rank_{F,T}$ is a function for outputting a rank $R_{F,T}(f, t)$ of X(f, t) in a subtraction block (F, T). F is an index in the frequency axis direction for the purpose of identifying a learning block, and $N_F(R_{F,T}(f, t))$ is a noise power of an element in the learning block (F) which has a rank corresponding to the rank $R_{F,T}(f, t)$. 'a' is a subtraction coefficient, and 'b' is a flooring coefficient. $M_{f,t}$ is the number of subtraction blocks to which the element (f, t) belongs, and Y(f, t) is an output to be made after a noise is reduced with regard to the observed value X(f, t). A learning block and a subtraction block correspond to each other when their indices Fs are the same, and the learning blocks and the subtraction blocks corresponding to each other have the same sizes and positions in the frequency axis directions thereof.

When the processing for reducing a noise with regard to an observed value X(f, t) of a certain element (f, t) is performed, first of all, a rank $R_{F,T}(f, t)$ concerning the element (f, t) in each sub-block (F, T) to which the element (f, t) belongs is found by use of an equation (1). Next, by use of the equation (2), $S_{F,T}(f, t)$ is found by subtracting a value from the observed value X(f, t), the value being found by multiplying, by a subtraction weight a, a noise power $N_F(R_{F,T}(f, t))$ of an element in a learning block F (F) corresponding to each rank $R_{f,t}(f, t)$ with a rank corresponding to the rank $R_{f,t}(f, t)$. Then, by use of the equation (3), what is the larger value out of an average of values $S_{F,T}(f, t)$ concerning the respective ranks $R_{F,T}(f, t)$ and a value to be found by multiplying the observed value X(f, t) by the flooring coefficient b is defined as a speech power Y(f, t) to be found after a noise is reduced.

Figure 9:
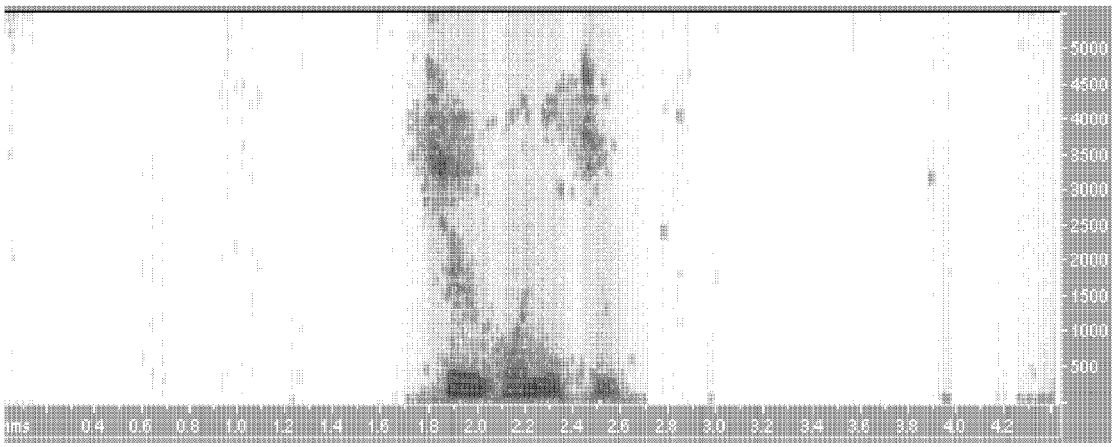
FIG. 9 is an example of a spectrogram of a speech signal to be obtained after noise reduction processing is performed for each observed value by use of an RBSS method according to the present invention.

FIG. 9 is a spectrogram of a speech signal to be obtained after the processing for reducing a noise is performed for each observed value X(f, t) by use of the RBSS method of such a kind. Incidentally, a subtraction weight a which has been used in the processing for reducing a noise is 1.5, a used flooring coefficient b is 0.0, and the size of a used subtraction block is 20×20 (the number of frames*the number of frequency sub-bands). It can be understood from the figure that, according to the RBSS method, a musical noise as shown in FIG. 6 can be reduced.

FIG. 1 is a system block diagram showing an example of a noise reduction device according to an embodiment of the present invention. This device is constituted of a computer and software in order to perform the aforementioned RBSS method. As shown in the figure, this device comprises: an FFT unit 11 for outputting an observed value X(f, t) on a basis of a received signal including a speech component and a noise component; a section determination unit 12 for determining whether or not each frame of the observed value X(f, t) belongs to a noise section; a learning block setting unit 13 for setting a learning block in a noise section of the observed value X(f, t); a noise power rank calculating unit 14 for calculating, for each element in the learning block, a rank by a power of the element; a subtraction block setting unit 15 for setting a subtraction block in the observed value X(f, t); a speech power rank calculating unit 16 for calculating, for each element in the subtraction block, a rank $R_{F,T}(f, t)$ by a power of the element; and a noise power calculating unit 17 for calculating a noise power to be subtracted from the observed value X(f, t) for each element in the subtraction block on a basis of results of calculating ranks by the respective rank calculating units 14 and 16; and a subtraction unit 18 for subtracting the calculated noise power from the observed value X(f, t), and for outputting a signal Y(f, t) from which the noise power is thus subtracted.

The FTT unit 11 subjects a received signal to a Rapid Fourier Transform with a predetermined frame length and a predetermined frame period, thereby outputting the observed value X(f, t) as a time series of a short time spectrum. The section determination unit 12 determines whether or not each frame (t) belongs to a noise section on a basis of a power value of the frame.

Figure 8:
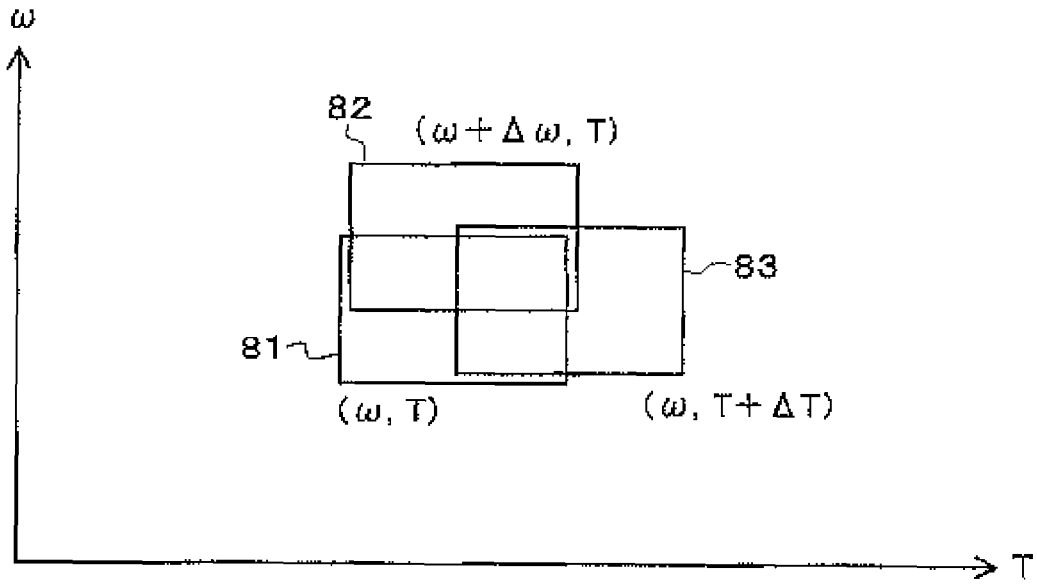
FIG. 8 is an example of a diagram showing overlapping among sub-blocks.

The learning block setting unit 13 sets a plurality of learning blocks in the frequency axis direction for each increase Δω in frequency as shown in FIG. 8, and sequentially renews a position in the time axis direction where a learning block is set in order to cause the position to be a predetermined timing position. As for this timing position, for example, a timing position which cause a learning block to be placed immediately before a speech section can be adopted. The noise power rank calculating unit 14 calculates a rank of each element by its power for each learning block each time the set position is renewed.

The small block setting unit 15 sets a plurality of small blocks in the frequency axis direction for each increase $\Delta\omega$ in a frequency as shown in FIG. 8, and sequentially renews a position where a small block is set in order to cause the position to sequentially change at predetermined time position intervals. The speech power rank calculating unit 16 calculates a rank of each element by its power for each subtraction block each time the set position is renewed.

The noise power calculating unit 17 acquires, as a noise power value, a power value of an element in a learning block corresponding to each subtraction block, the element being in the learning block whose relative rank agrees with each element in each subtraction block, for the subtraction block, each time the set position of the subtraction block is renewed. The subtraction unit 18 subtracts a noise power value corresponding to a power value of each element from the power value of the element for each subtraction block each time a set position of the subtraction block is renewed, and outputs a found value as a speech power value from which a noise is reduced.

Figure 2:
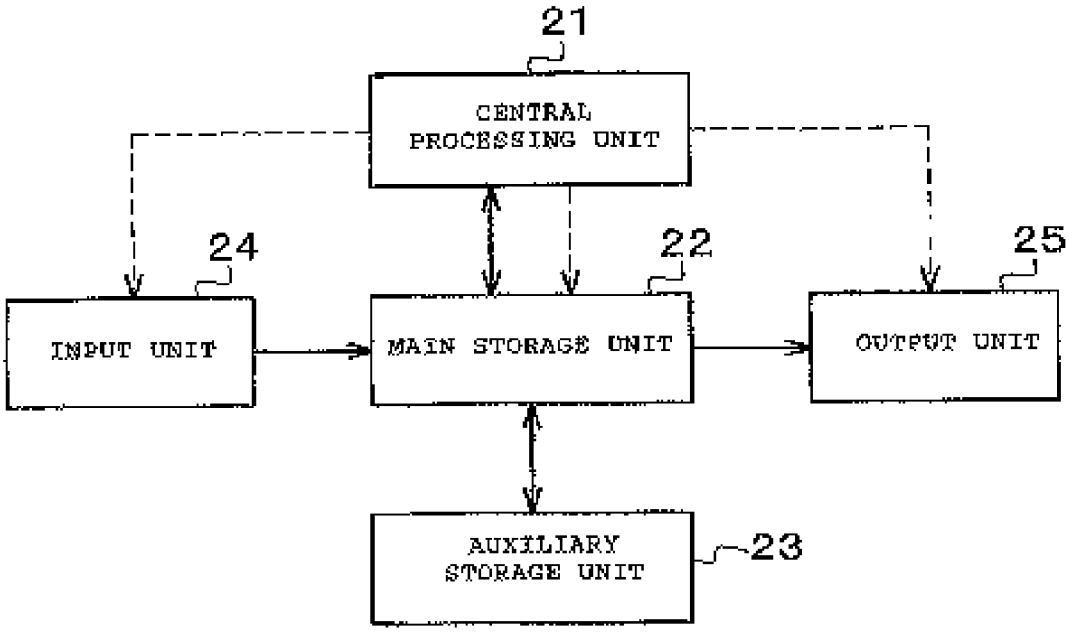
FIG. 2 is a block diagram showing an example of a constitution of a computer constituting the device of FIG. 1.

FIG. 2 is a block diagram showing an example of a computer constituting a device shown in FIG. 1. This computer comprises: a central processing unit 21 for performing data processing and control of each units on a basis of programs; a main storage unit 22 for storing a program which the central processing unit 21 is executing and data related to the program in order to enable the program and the data to be accessed at a high speed; an auxiliary storage unit 23 for storing the program and the data; an input unit 24 for inputting data and an instruction; an output unit 25 for outputting a result of processing by the central processing unit 21, and for performing a GUI function in cooperation with the input unit 24; and the like. Solid lines in the figure indicate flows of data, and broken lines indicate flows of control signals. A noise reduction program for causing the computer to perform a function in each unit in the device shown in FIG. 1 is installed in the computer. In addition, a microphone for generating an input signal to be supplied to the FFT unit 11 shown in FIG. 1 is included in the input unit 24.

Figure 3:
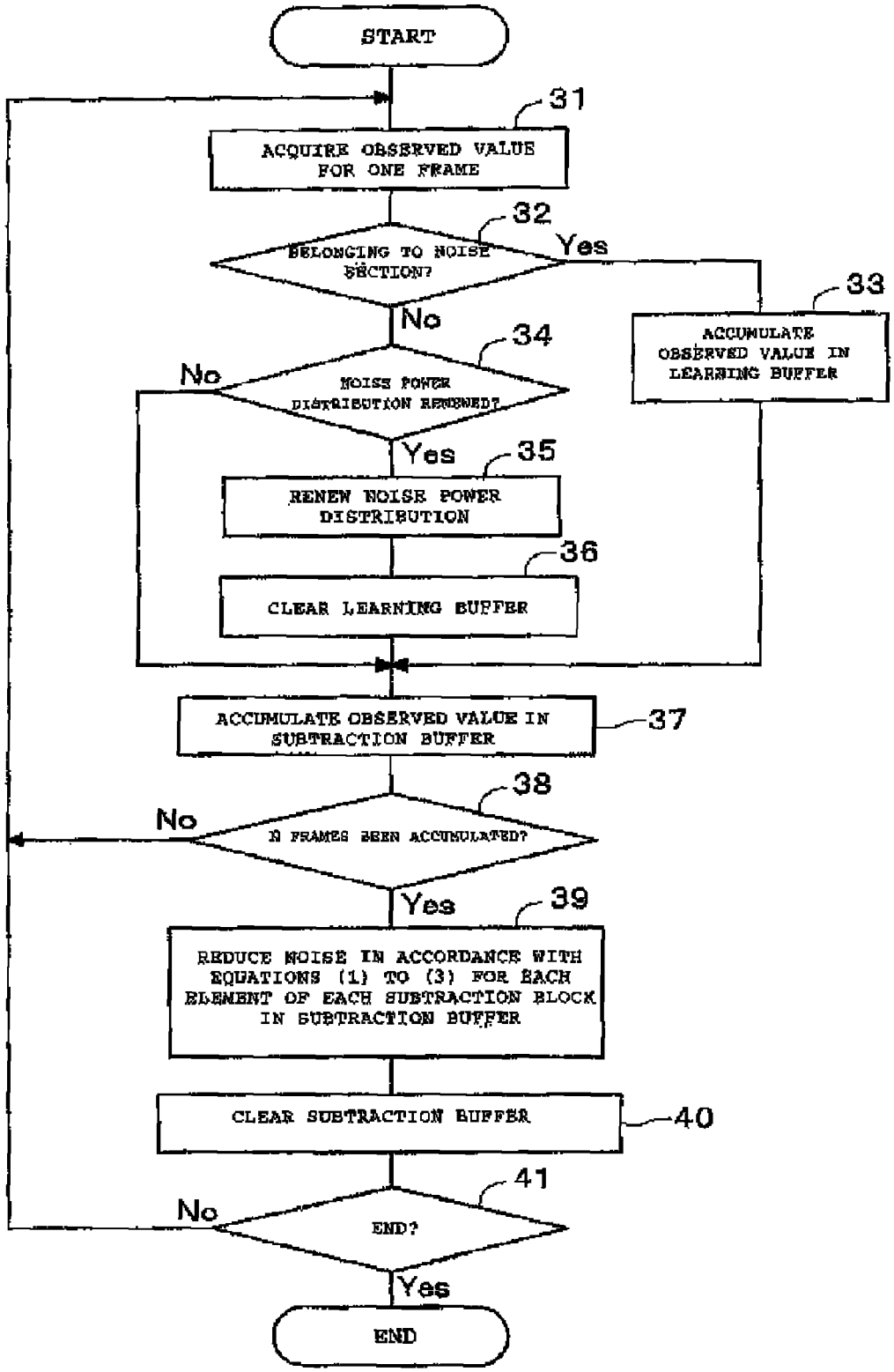
FIG. 3 is a flowchart showing an example of a procedure of processing in accordance with a noise reduction program in the device of FIG. 1.

FIG. 3 is a flowchart showing an example of a procedure for noise processing in accordance with a noise processing program in the device shown in FIG. 1. For your reference, in this processing, the size of a learning block is defined as N×m (the number of frames*the number of frequency sub-bands), and the size of a subtraction block is defined as n×m (the number of frames*the number of frequency sub-bands), and the number of leaning blocks and sub-blocks to be set in the respective frequency axis directions is defined as k. It is assumed that overlapping among blocks as shown in FIG. 8 be not present.

Once the processing is started, first, an observed value X(f, t) for one frame is acquired by the FTT unit 11 in step 31. Next, in step 32, the section determination unit 12 determines, on a basis of the acquired, observed value X(f, t), whether or not the frame belongs to a noise section. In a case where it is judged that the frame belongs to the noise section, the learning block setting unit 13 accumulates the acquired, observed value X(f, t) in a learning buffer in step 33, and the processing proceeds to step 37. Consequently, observed values X(f, t) are continuously accumulated in the learning buffer for each frame, as long as the noise section continues.

In a case where it is judged, in step 32, that the frame does not belong to the noise section, it is determined, in step 34, whether or not a renewal registration of a noise power distribution is to be made, that is whether or not a position where a learning block is set is to be renewed. A judgment that the renewal is to be made is formed in a case that observed values X(f, t) for N frames, continuous enough to constitute a learning block, has been accumulated. In a case where it is judged that the renewal registration of the noise power distribution is to be made, a rank of each element by its power is calculated, on a basis of the accumulated, observed values X(f, t) for recent N frames in step 35, for each learning block constituted of the observed values, accordingly registering the result as a new power distribution. By this, a round of learning concerning the noise power distribution is completed. This learning is an equivalent to the renewal of the position where the learning block is set. Subsequently, the learning buffer is cleared in step 36, and the processing proceeds to step 37. In a case where it is judged, in step 34, that the renewal registration of the noise power distribution is not to be made, the processing proceeds directly to step 37.

In step 37, an observed value X(f, t) for a most recent frame acquired in step 31 is accumulated in the subtraction buffer. Next, it is determined, in step 38, whether or not observed values X(f, t) for n frames corresponding to the size of a subtraction block in the time axis direction have been accumulated in the subtraction buffer. In a case where it is judged that the observed values have not been accumulated, the processing returns to step 31.

In a case where it is judged, in step 38, that the observed values for the n frames have been accumulated, in step 39, a rank $R_{F,T}(f, t)$ of each element is calculated by use of the aforementioned equation (1) for each subtraction block constituted of the observed values for the n frames in the subtraction buffer, and a noise power $N_F(R_{F,T}(f, t))$ is acquired with reference to a registered noise power distribution. In addition, a power value Y(f, t) from which noise is reduced is calculated, and is outputted, by use of the aforementioned equations (2) and (3).

Subsequently, the subtraction buffer is cleared in step 40. Unless it is judged, in step 41, that the processing is to be completed for a predetermined reason, the processing returns to step 31, and each of the aforementioned process is repeated. In this manner, each time observed values for n frames have been accumulated in the subtraction buffer, a power value Y(f, t) from which noise concerning the observed values for the N frames have been reduced is outputted. In other words, for each n frames, the position of the subtraction block in the time axis direction is sequentially renewed.

The followings should be noted. It is a prerequisite for this processing procedure that overlapping as shown in FIG. 8 is not present for each of the learning block and the subtraction block. However, in a case where overlapping is present, a noise power may be calculated for a unit including a block and its neighboring blocks instead of being calculated for a block unit, thereby allowing the averaging in the aforementioned equation (3) to be performed.

Figure 10:
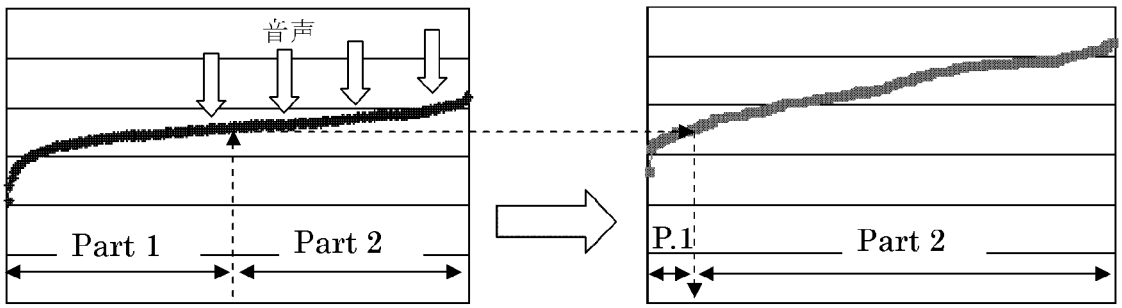
FIG. 10 is an example of a diagram showing an example of a theory for calculating a noise power in a noise reduction device according to another embodiment of the present invention.

FIG. 10 shows a method for calculating a noise power in a noise reduction device according to another embodiment of the present invention. This device has the same system constitution as the device shown in FIG. 1 does. However, this device is different from the device shown in FIG. 1 only in terms of processing to be performed in the noise power calculating unit 17. According to this, precision with which a noise power is estimated in the RBSS method can be further improved.

A graph in the left of FIG. 10 shows the same noise power distribution as FIG. 5 does. A graph in the right shows a power distribution to be caused when a speech power is superimposed on the noise power. For example, the following is considered; as in the case of Block2 in FIG. 4, when a speech power is superimposed on a noise power in a subtraction block in transition from the noise section to the speech section, the speech power is superimposed mainly on a position with a higher rank of the noise power as shown by arrows 101 in FIG. 10, since the speech power is relatively large. By this, the power distribution in the speech section as shown in the graph in the right of FIG. 10 has been generated. In this case, the power distribution in the speech section and the power distribution in the noise section are more exact compared to a case where the two power distributions are caused to correspond to each other on a basis of direct agreement between their relative ranks, when the rank axis of each of the two power distributions is divided into two segments with an appropriate size as shown in FIG. 10, one segment on the side of a lower rank in the power distribution of the noise section is caused to correspond to a smaller segment on the side of a lower rank in the power distribution of the speech section, and the other segment on the side of a higher rank in the power distribution of the noise section is caused to correspond to a larger segment on the side of a higher rank in the power distribution of the speech section.

Various methods are conceivable as the methodology for dividing a rank axis, and for causing segments with different sizes to correspond to each other, in this manner. FIG. 10 shows an example of the methodology. In other words, first of all, a segment in the left of a median of ranks in the power distribution of the noise section is defined as a section A, and a segment in the right thereof is defined as a section B. Next, a rank whose power is equal to that of a median of the ranks in the power distribution of the noise section is found in the power distribution of the speech section, and a segment in the left of the rank is defined as a segment A in the speech section, and a segment in the right thereof is defined as a segment B. Then, the segments A of the respective power distributions are caused to correspond to each other, and the segments B of the respective power distributions are caused to correspond to each other.

In this case, a calculation of a noise power in the noise power calculating unit 17 is made on a basis of agreement between relative ranks of the respective and corresponding segments. In other words, if a rank of an observed value X(f, t) to be targeted belongs to the segment B, a noise power whose relative power in the segment B in the noise power distribution agrees with a relative rank in the segment B is a noise power to be found.

Next, a result of performing noise reduction by use of the noise reduction device according to the embodiment shown in FIG. 10 is shown in FIGS. 11 to 14, comparing a condition prior to the noise reduction with a result of performing noise reduction adapted by the conventional SS method. As an observed signal, what is based on a speech pronunciation "Ko-ku-sa-i" voiced by a woman speaker in the compartment of a car while driving at a high speed is used. In addition, noise caused by the driving of the car is concentrated in a lower band. For this reason, the size of a sub-block is set narrow in the frequency axis direction so that the size is 50×4 (the number of frames*the number of frequency sub-band).

Figure 11:
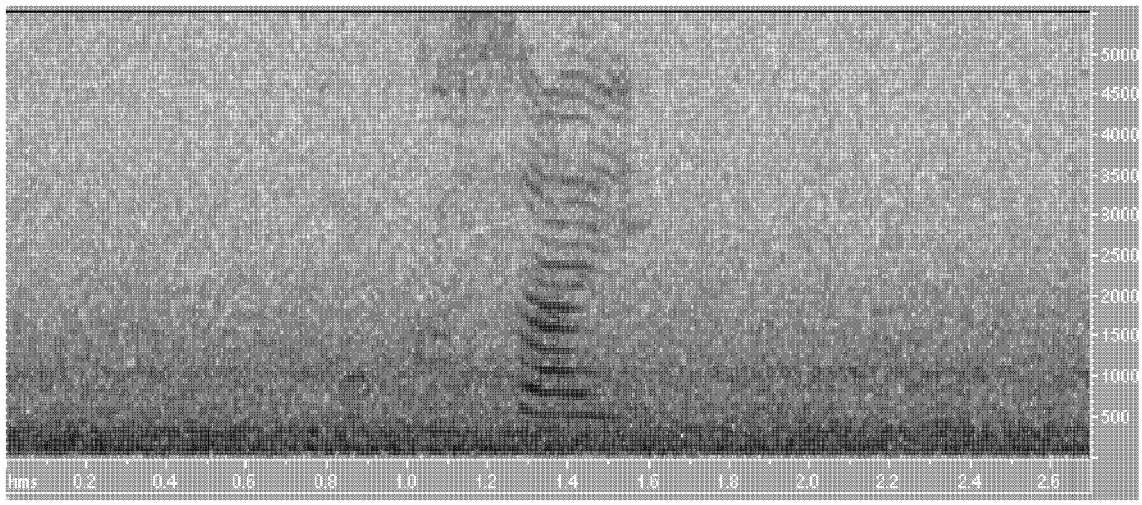
FIG. 11 is an example of a spectrogram of a speech to be exhibited before a noise is reduced.
Figure 12:
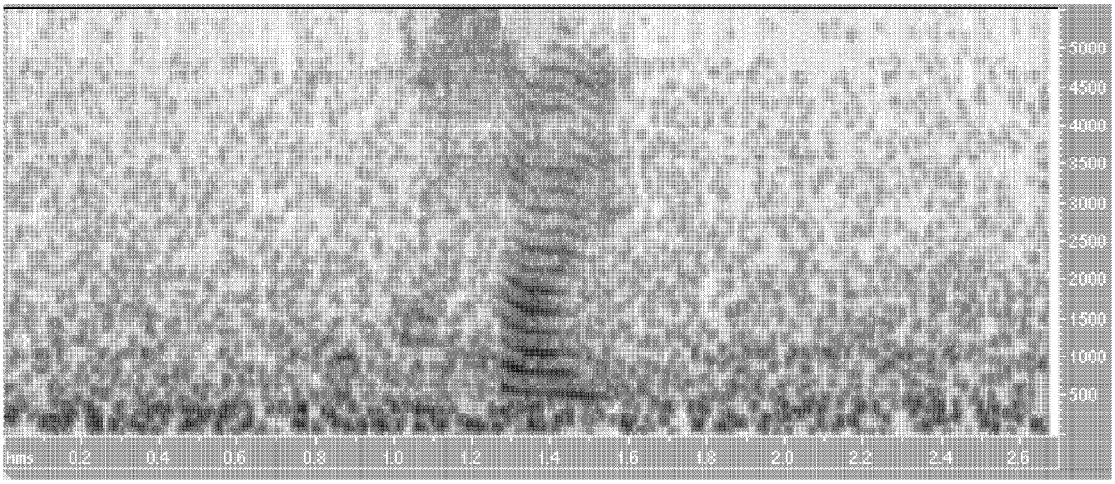
FIG. 12 is an example of a spectrogram of a speech to be obtained after a subtraction is done by use of the conventional SS method.
Figure 13:
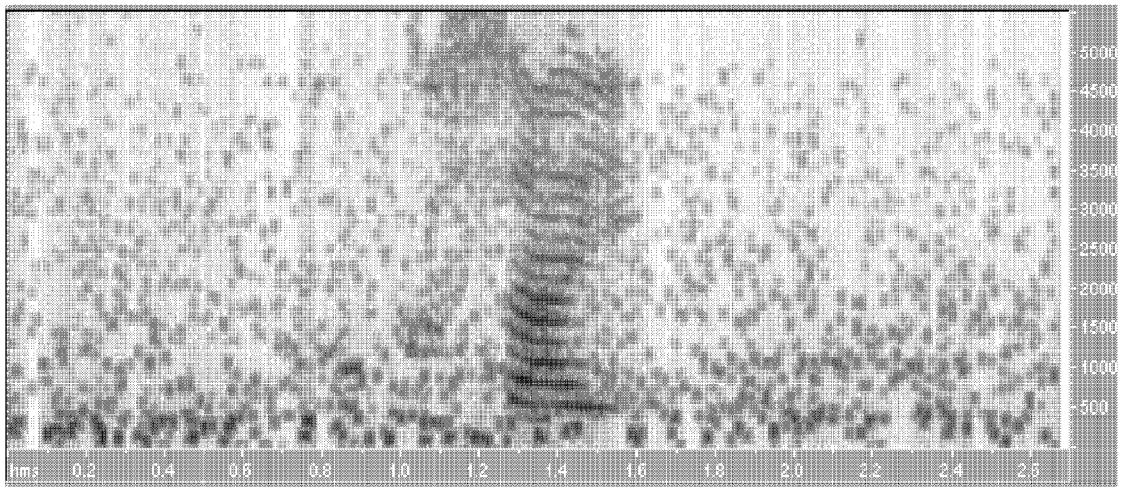
FIG. 13 is an example of another spectrogram of the speech to be obtained after the subtraction is done by use of the conventional SS method.

FIG. 11 is a spectrogram of the speech prior to noise reduction. FIGS. 12 and 13 are spectrogram of the speech for which a subtraction has been done by use of the conventional SS method. For your reference, a result shown in FIG. 12 is what is obtained in a case that a subtraction weight is 1.5 and a flooring coefficient is 0.0. A result shown in FIG. 13 is what is obtained in a case that the subtraction weight is increased from the subtraction weight given in FIG. 9 to 2.5. According to the conventional SS method, even if the subtraction weight is increased to 2.5, it is understood that a musical noise is conspicuously produced.

Figure 14:
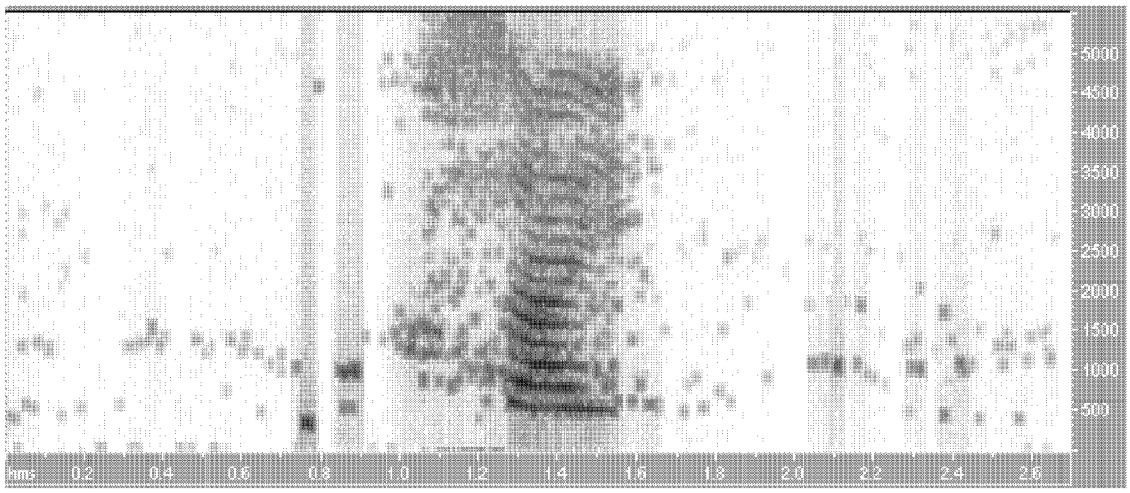
FIG. 14 is an example of a spectrogram of a speech to be obtained after a noise is reduced in accordance with an RBSS method according to the embodiment shown in FIG. 10.

FIG. 14 is a spectrogram of the speech to be obtained after noise reduction is done in accordance with the RBSS method of the embodiment shown in FIG. 10. For your reference, a used subtraction weight is 1.5, and a used flooring coefficient is 0.0. It is understood that an amount of produced musical noise is extremely small compared to the case where the conventional SS method is employed.

Next, a result of verifying through an experiment performance to be exhibited in a case that the noise reduction device according to each of the aforementioned embodiments is adapted to speech recognition is shown. The experiment has been carried out on a basis of signals received through the following conditions; each of eight speakers (four men and four women) spoke 40 sentences in the compartment of a car being in a state that the engine is off, and a microphone mounted on the sun visor received their speeches. Contents of a speech are constituted of one to eleven digits (digits; a series of numbers without a figure) for a sentence. The total number of words spoken was 2,538. In addition, another experiment has been carried out where noise caused by a car in motion which was recorded while the car was driven at 100 km per hour was superimposed on the received signals, and received signals which were obtained by simulating talks to be made while the car was in motion were used. When the experiment was carried out, a sampling frequency for recording was defined as 22 KHz, and speech recognition was performed by use of a clean acoustic model in a ViaVoice desktop dictation product which is an IBM speech recognition program.

Figure 15:
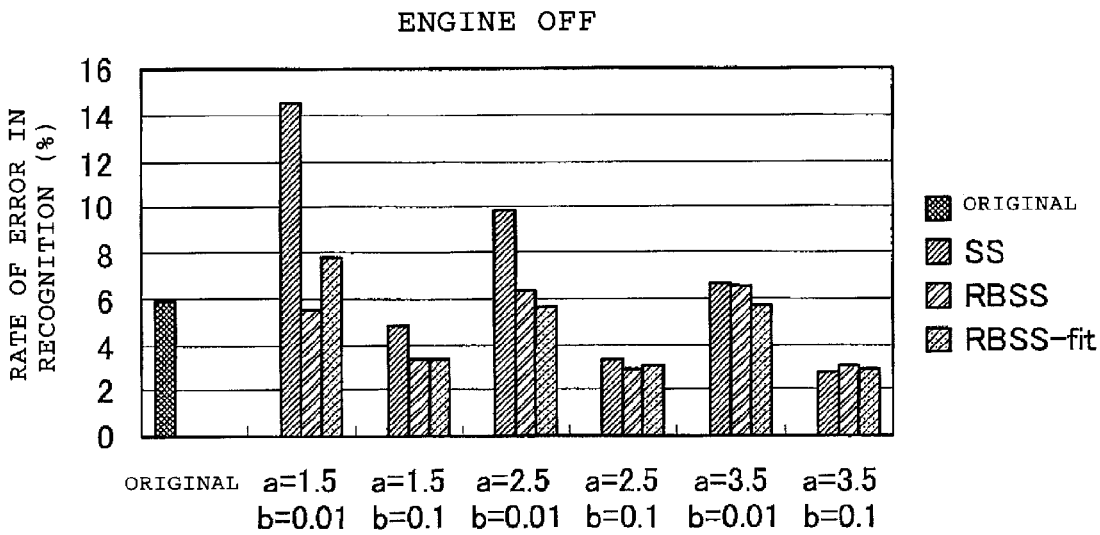
FIG. 15 is a graph showing an example of a result of speech recognition on a basis of a signal received while an engine is off for the purpose of showing an effect of the present invention.
Figure 16:
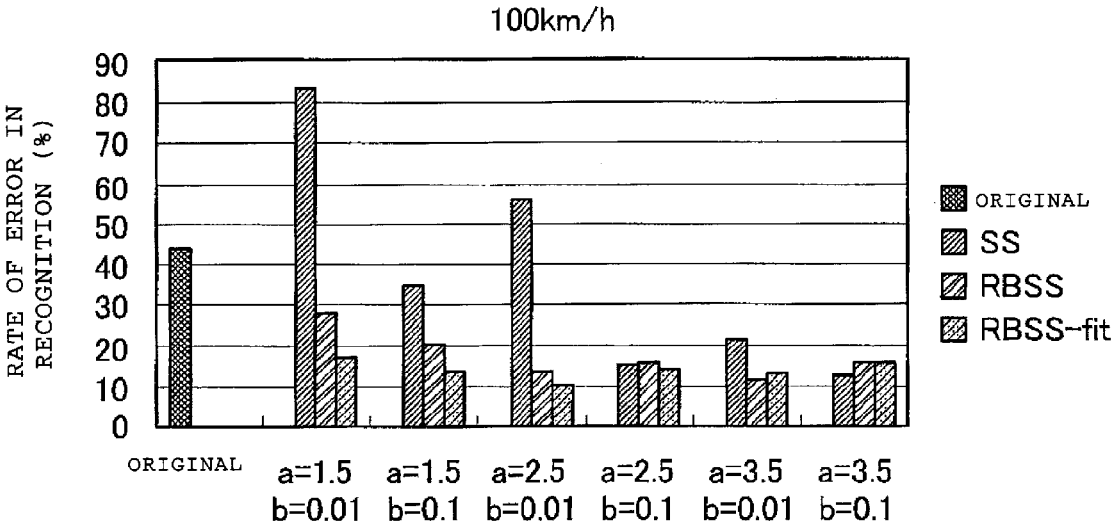
FIG. 16 is a graph showing an example of a result of speech recognition on a basis of a signal received while a car is driven at 100 km per hour for the purpose of showing an effect of the present invention.

FIG. 15 is a graph showing an example of a result of speech recognition on a basis of signals received when the engine was off. FIG. 16 is a graph showing an example of a result of speech recognition on a basis of signals received when the vehicle was driven at 100 km per hour. WER(%) in the vertical direction stands for Word Error Rate. "Original" in the figure stands for a result obtained when an original speech which had not been processed was used. "SS" stands for a result obtained by use of the conventional SS method, and "RBSS" stands for a result obtained by use of the device of FIG. 1 according to the RBSS method. "RBSS-fit" stands for a result obtained in accordance with the embodiment of FIG. 10. "a" is a subtraction weight, and "b" is a flooring coefficient.

It is understood, from FIGS. 15 and 16, that, both in a case that the engine was off and on a case that the car was driven at 100 km per hour, according to the conventional SS method, the rate of error in recognition is conspicuously increased when the subtraction weight a is small, or when the flooring coefficient b is small. By contrast, it is understood that, according to the RBSS method, the rate of error in recognition is hardly susceptible to an influence caused by variation of parameters 'a' and 'b'. For example, in a case that the flooring coefficient is fixed at 0.1, even if the subtraction weight varies between 1.5 and 3.5, the rate of error in recognition hardly changes. Accordingly, the rate of recognition is always maintained to be close to the best.

Furthermore, in a case that the car is driven at 100 km per hour, even if the flooring coefficient is a smaller coefficient or 0.01, the rate of recognition is similarly maintained to be close to the best. In a case that the engine is off, if the flooring coefficient is the smaller coefficient or 0.01, the rate of error in recognition is increased. However, the pattern of the increase is extremely gradual compared to the case where the conventional SS method is employed. In a case that the car is driven at 100 km per hour, even if various values are selected as the parameters a and b, the RBSS method according to the embodiment shown in FIG. 10 exhibits a better result than the RBSS method performed by the device shown in FIG. 1 does.

Figure 17:
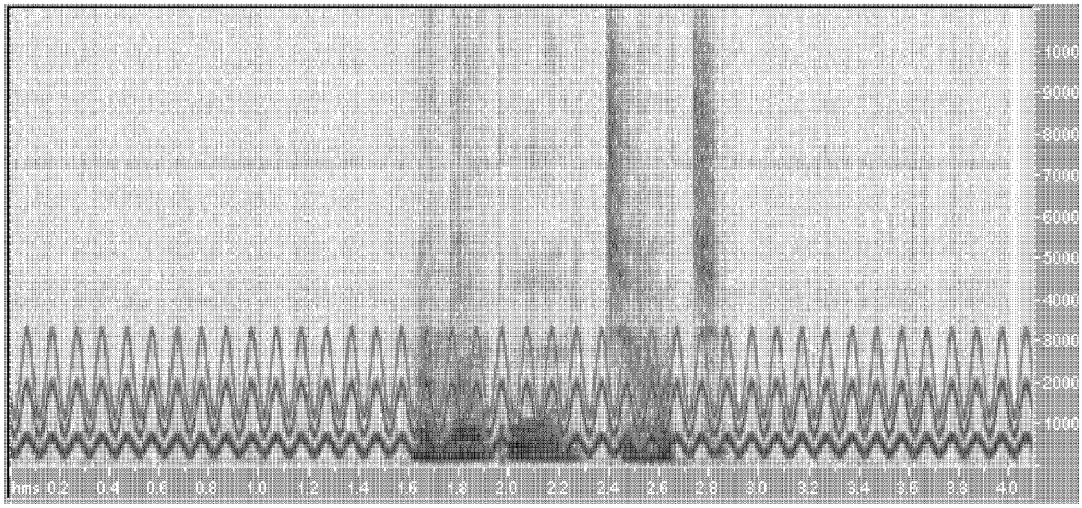
FIG. 17 is a spectrogram of a speech to be obtained by superimposing a periodic noise on a speech pronunciation made by a woman.
Figure 18:
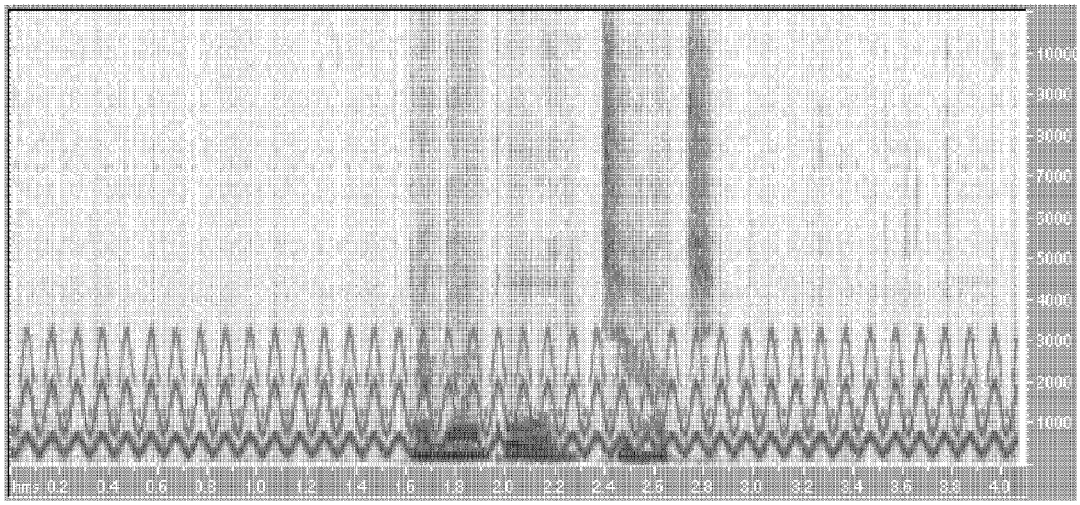
FIG. 18 is a spectrogram of the speech shown in FIG. 17 to be obtained when the processing is performed by use of the conventional SS method.

Next, it will be proved that the noise reduction devices according to the respective embodiments aforementioned are effective in a case that a periodic noise is superimposed on a received signal. FIG. 17 is a spectrogram of a speech which is obtained when periodic noise is superimposed on a speech pronunciation "Shichi-Go-Ichi-Hachi" voiced by a woman. FIG. 18 is a spectrogram of the speech to be obtained when the processing is performed by use of the conventional SS method with the subtraction weight and flooring coefficient defined as 1.5 and 0.0 respectively. By the conventional SS method, a periodic noise is not reduced from a speech even after the processing is performed for the speech. This is because an average of a noise power is to be subtracted uniformly.

Figure 19:
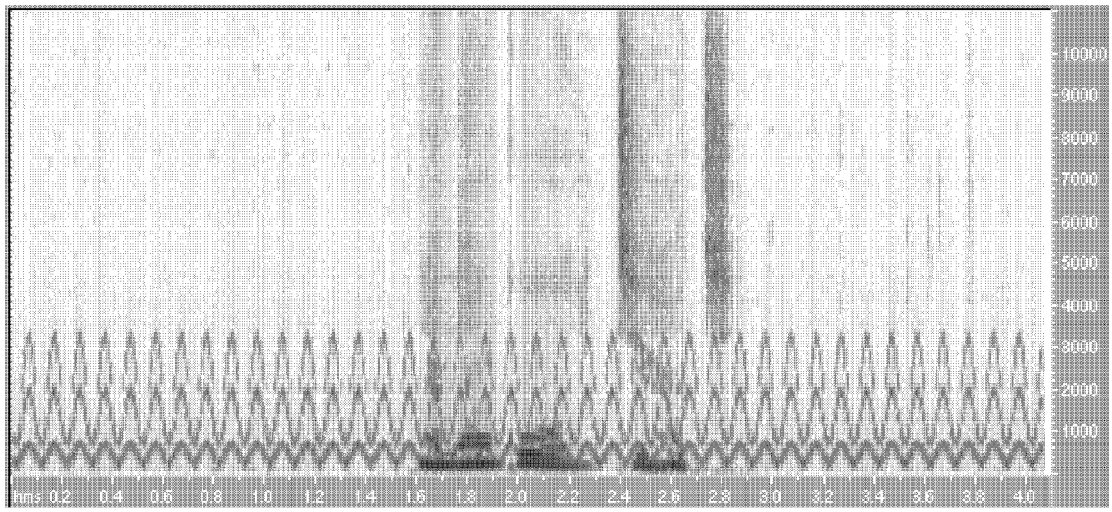
FIG. 19 is a spectrogram of the speech shown in FIG. 17 to be obtained when the processing is performed by use of the conventional SS method with a subtraction weight increased.

FIG. 19 is a spectrogram of the speech shown in FIG. 17 to be obtained in a case that the processing is performed by use of the conventional SS method by increasing the subtraction weight from one employed in FIG. 18 to 3.5. It is understood from FIGS. 18 and 19 that the periodic noise is not reduced by the conventional SS method even if the subtraction weight is increased.

Figure 20:
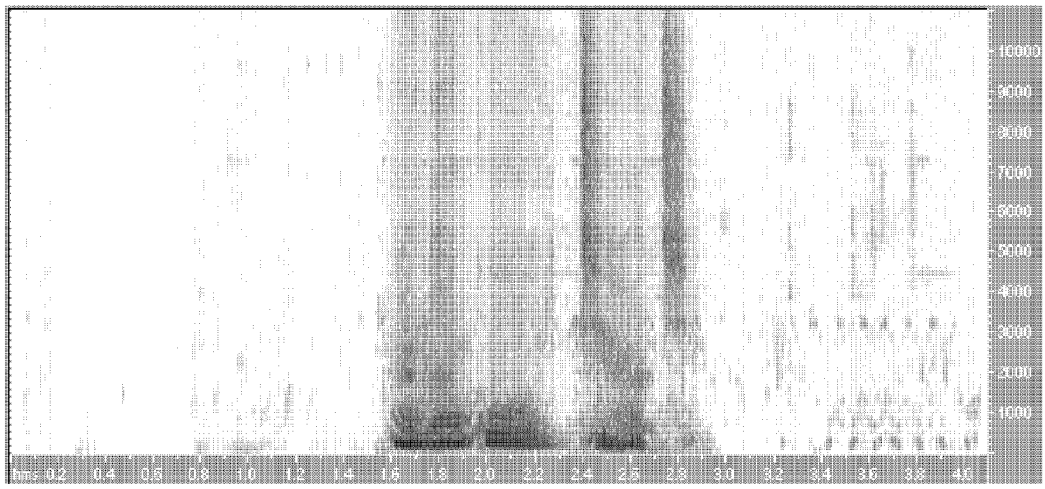
FIG. 20 is a spectrogram of the speech shown in FIG. 17 to be obtained when the processing is performed by use of the noise reduction device shown in FIG. 1.

FIG. 20 is a spectrogram of a speech signal to be obtained by processing the speech shown in FIG. 17 by use of the noise reduction device shown in FIG. 1. A used subtraction weight is 1.5, a used flooring coefficient is 0.0, and the size of a used subtraction block is 10×10. By use of the RBSS method, a noise component is reduced as a texture pattern of a subtraction block unit. For this reason, almost all the periodic noise can be reduced as shown in FIG. 20, by setting the sub-block larger than the cycle of the periodic noise.

It should be noted that the present invention is not limited to the aforementioned embodiments, and that the present invention can be carried out by modifying it when deemed necessary. For example, in the aforementioned embodiments, the sizes of the learning block and the subtraction block have been fixed. Instead, however, their sizes may be changed for each frequency depending upon properties of a noise component. For example, in a case where it is understood in advance that noise is concentrated in a certain frequency band, a block may be set whose size is short in the frequency axis direction and long in the time axis direction within the frequency band. In addition, in a case that a noise component is a white noise which is a noise dispersed uniformly in all the frequency bands, the size of each block in the frequency axis direction may be set larger.

The present invention can be realized in hardware, software, or a combination of hardware and software. The present invention can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which—when loaded in a computer system—is able to carry out these methods.

Computer program means or computer program in the present context mean any expression, in any language, code or notation, of a set of instructions intended to cause a system having an information processing capability to perform a particular function either directly or after conversion to another language, code or notation and/or reproduction in a different material form.

It is noted that the foregoing has outlined some of the more pertinent objects and embodiments of the present invention. This invention may be used for many applications. Thus, although the description is made for particular arrangements and methods, the intent and concept of the invention is suitable and applicable to other arrangements and applications. It will be clear to those skilled in the art that other modifications to the disclosed embodiments can be effected without departing from the spirit and scope of the invention. The described embodiments ought to be construed to be merely illustrative of some of the more prominent features and applications of the invention. Other beneficial results can be realized by applying the disclosed invention in a different manner or modifying the invention in ways known to those familiar with the art.

What is claimed is:

1. A noise reduction method, comprising:

calculating a rank for each element included in a first region using a computer processor apparatus, depending on a value of the element, the first region having predetermined sizes in a time axis direction and in a frequency axis direction in a noise section of an observed signal indicating variation of a frequency spectrum with time;

calculating a rank for each element included in a second region, depending on a value of the element, the second region having predetermined sizes in the time axis direction and in the frequency axis direction in the observed signal; and subtracting, from values of the respective elements in the second region, values based on the values of the respective elements in the first region whose ranks correspond to the ranks of the respective elements in the second region.

2. The noise reduction method according to claim 1, comprising a region setting step for setting a plurality of the first and the second regions in the frequency axis direction for each of predetermined increases of a frequency, of sequentially renewing a position where the first region is set in order to cause the position to be a predetermined timing position in the time axis direction, and of sequentially renewing a position where the second region is set in order to sequentially change the position at predetermined time position intervals.

3. The noise reduction method according to claim 1, comprising a region setting step for setting a plurality of the first and the second regions in the frequency axis direction for each of predetermined increases of a frequency, and of concurrently changing the sizes of the first and second regions, respectively depending on a condition of a distribution of noise components in the frequency axis direction.

4. The noise reduction method according to claim 1, comprising a region setting step for setting the sizes of the first and second regions in the respective time axis directions equal to, or larger than, a cycle of periodic noise in the case where components of the periodic noise is included in the observed signal.

5. The noise reduction method according to claim 1, wherein an element in the first region whose rank corresponds to that of an element in the second region is an element in the first region whose relative rank corresponds to that of an element in the second region.

6. The noise reduction method according to claim 1, wherein ranks of the respective elements of the first and second regions are segmented into a plurality of ranges of ranks in each of the first and second regions, segments of the first region and segments of the second region correspond to each other sequentially starting from a lower rank, and the segments of the first region and the corresponding segments of the second region are different in terms of the range of their relative ranks; and an element in the first region whose rank corresponds to that of an element in the second region is an element belonging to a segment of the first region corresponding to a segment to which an element of the second region belongs, and concurrently an element whose rank in the segment of the first region relatively agrees with that of an element of the second region in a segment of the second region.

7. The noise reduction method according to claim 6, wherein ranks of the respective elements in the first region are divided into two ranges of ranks by defining a median of all the ranks as a boundary, and ranks of the respective elements in the second region are divided into two ranges of ranks by defining as a boundary a rank of an element in the second region whose value is equal to the value of the median.

8. The noise reduction method according to claim 1, wherein the observed signal is what is obtained by converting a speech signal, which a noise component is superimposed on, into a time series of a short time spectrum by a predetermined frame length and by a predetermined frame cycle;

the element is present in each frame for each frequency sub-band;

the first region has a size to be obtained by multiplying a predetermined number of frames by a predetermined number of frequency sub-bands; and the second region has a size to be obtained by multiplying predetermined number of frames by the same number of frequency sub-bands as the first region has.

* * * * *